US005564247A

United States Patent [19]

Nakamura et al.

[11] Patent Number: 5,564,247

[45] Date of Patent: Oct. 15, 1996

[54] HIGH-RIGIDITY SHEET-METAL STRUCTURE

[75] Inventors: Keiichi Nakamura, Tokyo; Masaru Kunikata, Shimizu; Takehisa Yoshikawa, Yokohama; Yoshiro Maita; Shunji Sasaki, both of Shimizu, all of Japan

[73] Assignee: Hitachi, Ltd., Tokyo, Japan

[21] Appl. No.: 314,069

[22] Filed: Sep. 28, 1994

[30] Foreign Application Priority Data

Sep. 28, 1993 [JP] Japan ..... 5-241363

[51] Int. Cl.[6] ..... B21D 13/00; B21D 13/10

[52] U.S. Cl. ..... 52/630; 428/603

[58] Field of Search ..... 52/630, 658, 573.1; 428/603, 595, 599

[56] References Cited

U.S. PATENT DOCUMENTS 3,395,438 8/1968 Seeff ..... 52/630 X 4,380,573 4/1983 Näslund ..... 52/630 X

FOREIGN PATENT DOCUMENTS 63-242421 7/1988 Japan .

*Primary Examiner*—Robert Canfield

*Attorney, Agent, or Firm*—Antonelli, Terry, Stout & Kraus

[57] ABSTRACT

In a high-rigidity structure made of sheet metal, in order to prevent increases of vibrations and noises owing to deterioration of the rigidity caused by decreasing the thickness of the sheet-metal, ribs having a height 10 times or more larger than the sheet-metal thickness are formed on bent portions of the sheet-metal structure, corrugated continuous grooves having two or more crest portions are formed on a surface of each of the bent portions on a smaller-radius side, and concave/convex sections corresponding to the continuous grooves are formed on side surfaces of each of the ribs which connect a larger-radius side and the smaller-radius side.

8 Claims, 5 Drawing Sheets

HIGH-RIGIDITY SHEET-METAL STRUCTURE

BACKGROUND OF THE INVENTION

1. Industrial Field of the Invention

The present invention relates to a light-weight high-rigidity structure made of thin sheet metal which includes corrugated ribs of a large height formed on bent portions of the structure.

2. Description of Related Art

Recently, saving energy and resources by reducing weights of products has been demanded for solving problems of the global environment. Especially, there has been a strong demand for decreasing the sheet thickness of sheet-metal structures such as shells and covers which have little direct influence on the functions of products. In general, when a sheet-metal box structure such as a shell and a cover is reduced in weight by decreasing its thickness, the resultant decrease in rigidity can be prevented by a complicated sheet-metal structure including more component parts and more fastening portions. However, as an inexpensive method, beads for plane portions or ribs for bent portions or both the beads and the ribs have conventionally been employed.

Design principles of beads and ribs are disclosed in, for example, (1) "Press-Bending Process", written by Akira Hashimoto, published by the Nikkan Kogyo Shinbun, Ltd., (2) "Sheet-Metal Working Methods", written by Kensuke Nozawa, published by the Nikkan Kogyo Shinbun, Ltd., and (3) "Plastic Working", written by Teizo Maeda, published by Seibundo Shinkosha Corporation. According to these literatures, the standard height of beads formed on plane portions is defined 3 to 5 times larger than the sheet thickness. It is known that the rigidity of ribs formed on bent portions is enhanced as the height of the ribs is increased. However, since a difference between peripheral lengths on the larger-radius side and the smaller-radius side in each bent portion is increased, buckling occurs on the smaller-radius side, thereby making the rib formation difficult. Consequently, the standard height of ribs is 2 times larger than the sheet thickness.

However, in order to satisfy the current demand for weight reduction, there is a limit especially in the reinforcement by the conventional ribs on the bent portions. Moreover, when some of the mechanical component elements such as a motor are mounted on a shell or the like, vibrations and noises owing to deterioration of the rigidity caused by decreasing the sheet thickness are inevitably increased.

SUMMARY OF THE INVENTION

The present invention has been thought out on the basis of the above-described strong demand for weight reduction. It is an object of the invention to provide a high-rigidity structure made of thin sheet metal which includes ribs of a large height formed on bent portions of the structure, so that vibrations and noises owing to deterioration of the rigidity caused by decreasing the sheet thickness can be prevented from increasing.

In order to achieve the above object, this invention is characterized in that the height of the ribs formed on the bent portions is 10 times or more larger than the thickness of the sheet metal, corrugated continuous grooves having two or more crest portions are formed on a surface of each of the bent portions on a smaller-radius side so as to absorb a difference between the peripheral lengths on a larger-radius side and the smaller-radius side, and concave/convex sections corresponding to the continuous grooves are formed on side surfaces of the ribs on the bent portions which connect the larger-radius side and the smaller-radius side.

This will be described more specifically below. In formation of a rib of the conventional structure which has a height 10 times or more larger than the thickness of sheet metal, if a portion of the sheet metal to be a rib after bending is formed in a certain shape in advance, and bending is thereafter performed, buckling occurs or the shape is lost. That is the following reason: When the portion to be a rib is formed on the plane sheet metal, the length of the rib on the smaller-radius side-is equal to that on the larger-radius side. However, when bending is performed, the peripheral length of the rib on the smaller-radius side is shorter than that on the larger-radius side by a degree corresponding to a formula ($h\pi/2$) expressed with the rib height h. Consequently, the sheet metal is superfluous by this degree, thereby causing buckling.

In the present invention, the continuous grooves of the corrugated shape which can absorb the superfluous length on the smaller-radius side of each rib are formed on the smaller-radius side of the rib, and the concave/convex sections corresponding to the continuous grooves are formed on the side surfaces of the rib on the bent portion which connect the larger-radius side and the smaller-radius side, so that the length of the larger-radius side and that of the smaller-radius side will be apparently the same. Thus, generation of the above-described drawbacks can be prevented.

The height of the ribs on the bent portions is remarkably larger than that of the conventional ribs. Also, the corrugated continuous grooves are formed on the smaller-radius side of each rib, and the concave/convex sections corresponding to the continuous grooves are formed on the side surfaces of the rib so that the rigidity can be made remarkably higher than that of a sheet-metal structure having the conventional ribs. Therefore, the thickness and the weight of a shell, a cover or the like can be reduced. Moreover, the continuous grooves having the corrugated shape which are formed on the smaller-radius side of the bent portions absorb vibrations. Consequently, when such a structure is used especially as a shell, a cover or the like on which heavy articles or vibration sources such as a motor are directly mounted, noises can be advantageously reduced.

DETAILED DESCRIPTION OF THE PREFERRED EMBODIMENTS

The preferred embodiments according to the present invention will be hereinafter described with reference to the attached drawings.

Figure 1:
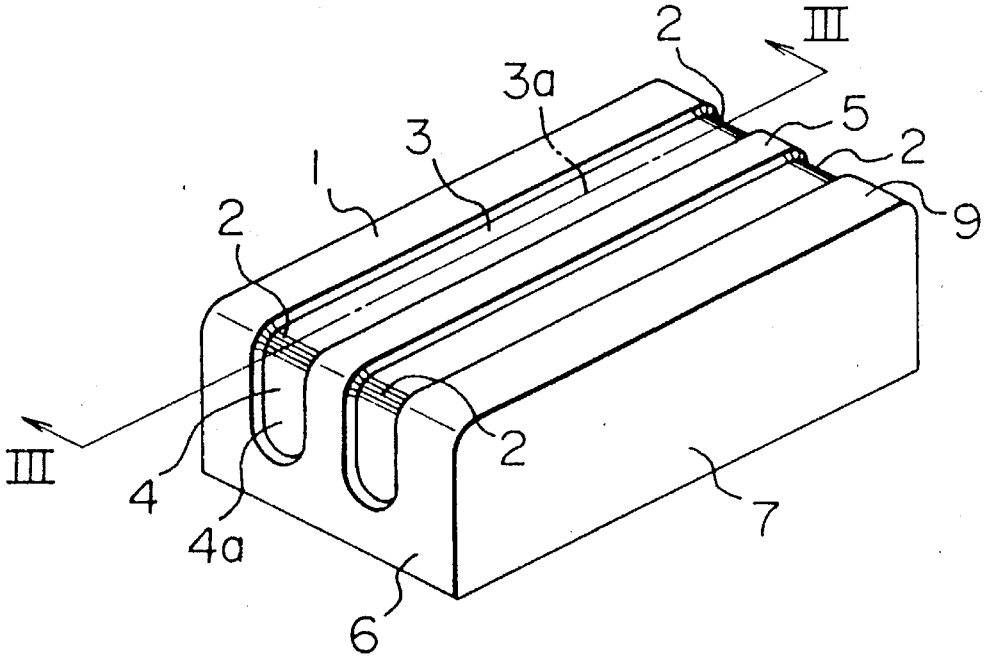
FIG. 1 is a whole explanatory perspective view of a sheet-metal box structure according to one embodiment of the present invention, as viewed from the bottom.

FIG. 1 is a whole explanatory perspective view of a sheet-metal box structure according to one embodiment of the invention, as viewed from the bottom. Reference numeral 1 denotes the sheet-metal box structure, 2 a corrugated rib formed on a bent portion, 3 a bottom bead continuously extending from the corrugated rib 2 so as to enhance rigidity of a bottom portion 5, 3*a* a surface of the bottom bead, 4 a side bead similarly formed on a side portion 6 with beads, 4*a* a surface of the side bead, 7 a side portion without beads, and 9 a bent portion.

Figure 2:
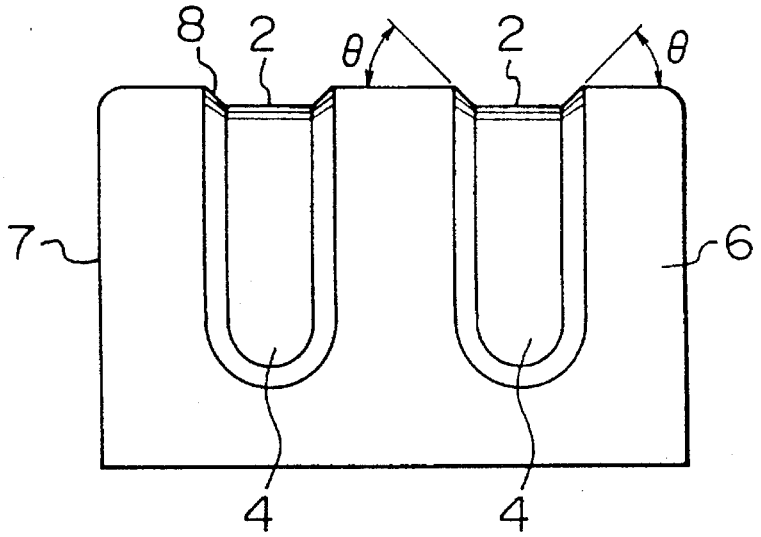
FIG. 2 is a side view of the sheet-metal box structure shown in FIG. 1.
Figure 3:
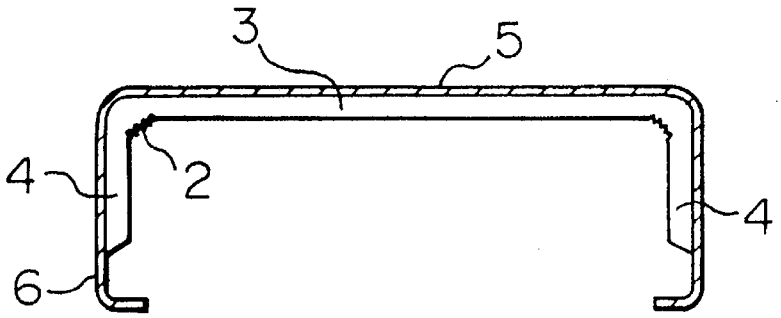
FIG. 3 is a cross-sectional view of the sheet-metal box structure shown in FIG. 1, taken along the line III—III.

FIG. 2 is a side view of the sheet-metal box structure 1, in which reference character θ denotes a taper angle of a taper portion 8 of the rib and bead having a trapezoidal cross-sectional configuration. FIG. 3 is a cross-sectional view of the sheet-metal box structure 1 shown in FIG. 1, taken along the line III—III. As shown in FIG. 3, the ribs and beads are formed continuously from a side bead 4 formed on a side portion 6 with beads, to a corrugated rib 2, a bottom bead 3 formed on the bottom portion 5, and a side bead 4 on the opposite side.

Figure 4:
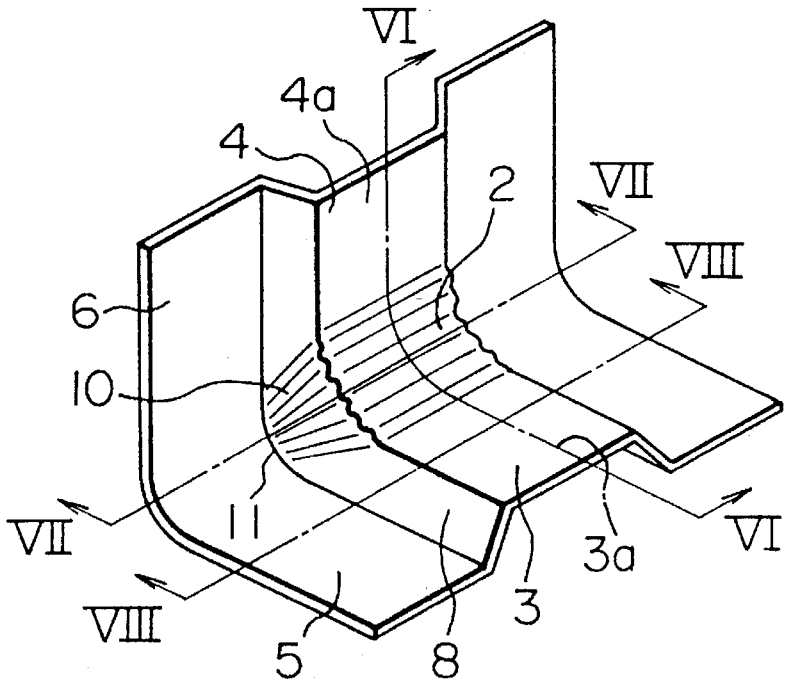
FIG. 4 is an explanatory perspective view of a portion of a corrugated rib formed on a bent portion of the sheet-metal box structure shown in FIG. 1, as viewed from the inside of the bent portion.
Figure 5:
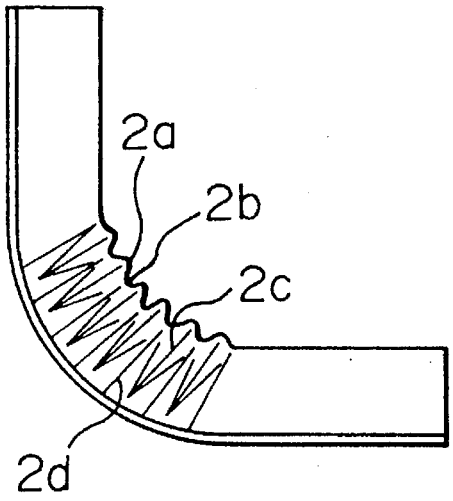
FIG. 5 is an enlarged side view of the corrugated rib formed on the bent portion of FIG. 4.
Figure 6:
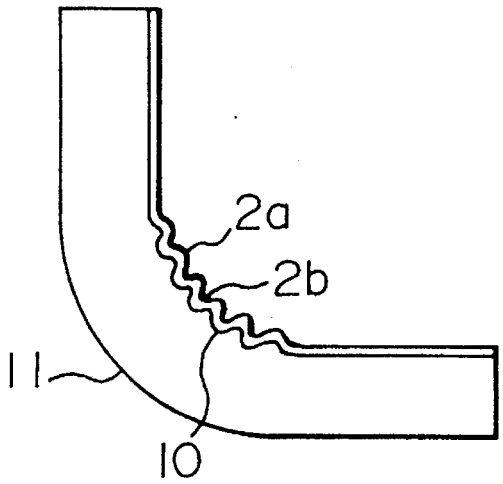
FIG. 6 is a cross-sectional view of the corrugated rib formed on the bent portion of FIG. 4, taken along the line VI—VI.

FIG. 4 is an explanatory perspective view of a portion of a corrugated rib 2 of the sheet-metal box structure 1 shown in FIG. 1, as viewed from the inside of a bent portion. FIG. 5 is an enlarged side view of the corrugated rib 2 shown in FIG. 4, and FIG. 6 is a cross-sectional view of the same, taken along the line VI—VI. The corrugated rib 2 formed on the bent portion 9 of the sheet-metal box structure 1 includes smaller-radius concave/convex sections 2*b* and 2*a* having a corrugated, continuous triangular cross-sectional configuration. More specifically, six smaller-radius convex sections 2*a* and five smaller-radius concave sections 2*b* extending perpendicular to the bending direction are formed on a surface of the bent portion 9 on a smaller-radius side 10. The corrugated rib 2 also includes taper convex Sections 2*c* and taper concave sections 2*d* which are formed on a taper portion 8 interconnecting a larger-radius side 11 and the smaller-radius side 10. The taper convex sections 2*c* and the taper concave sections 2*d* correspond to the smaller-radius concave/convex sections 2*b* and 2*a* formed on the smaller-radius side 10.

Figure 7:
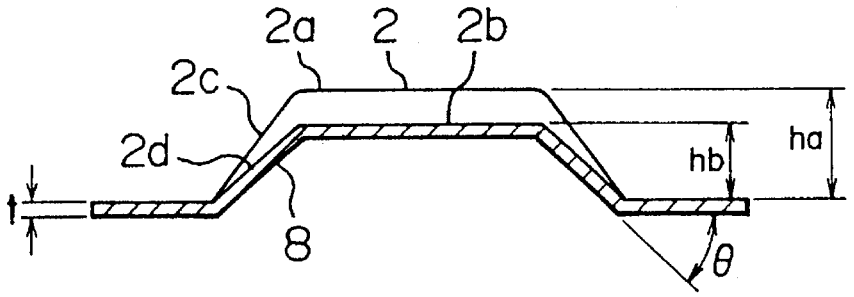
FIG. 7 is a cross-sectional view of the corrugated rib formed on the bent portion of FIG. 4, taken along the line VII—VII.
Figure 8:
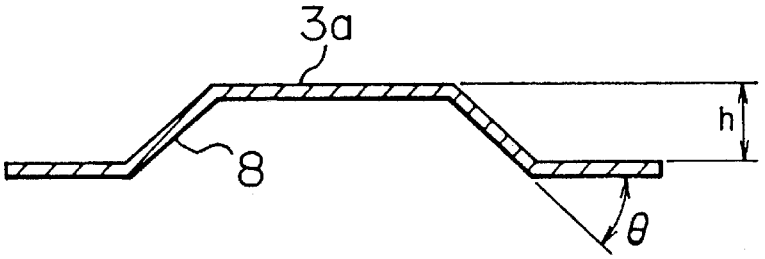
FIG. 8 is a cross-sectional view of the corrugated rib formed on the bent portion of FIG. 4, taken along the line VIII—VIII.

FIG. 7 is a cross-sectional view of the corrugated rib 2 shown in FIG. 4, taken along the line VII—VII, and FIG. 8 is a cross-sectional view of the same, taken along the line VIII—VIII. FIGS. 4, 7 and 8 show an example in which a height hb of a smaller-radius concave section 2*b* of the corrugated rib 2 from the larger-radius side 11 (hereinafter referred to as the rib height hb) is equal to a bead height h of a side bead 4 formed on the side portion 6 with beads and a bottom bead 3 formed on the bottom portion 5. Therefore, a height ha of a smaller-radius convex section 2*a* of the corrugated rib 2 from the larger-radius side 11 is larger than the rib height hb. In this case, the rib height hb is 10 times or more larger than a thickness t of sheet metal which constitutes the whole sheet-metal box structure 1.

The rib height hb is designed in such a manner that a continuous length of the smaller-radius concave/convex sections 2*b* and 2*a* in the bending direction is 1 to 1.4 times larger than a peripheral length of the bent portion on the larger-radius side 11.

This design is based on the following reason: When the peripheral length of the bent portion on the larger-radius side is considered as a fundamental matter, the length of the continuous grooves on the smaller-radius side is ideally equal to the foregoing peripheral length on the larger-radius side. Actually, however, the material elongates especially at the crest portions on the smaller-radius side while the grooves are formed, and consequently, the continuous length on the smaller-radius side is larger than the peripheral length on the larger-radius side. In this case, if the material uniformly elongates 1.4 times or more, i.e., 40% or more, it exceeds the elongation limit (about 35%) of the material, which results in a fear of rupture. Actually, since the material elongates locally, 1.4 times elongation on average is set as the limit. Besides, the taper angle θ of a taper concave section 2*d* formed on the taper portion 8 is equal to a taper angle θ of a side bead 4 formed on the side portion 6 with beads and a bottom bead 3 formed on the bottom portion 5.

Figure 10:
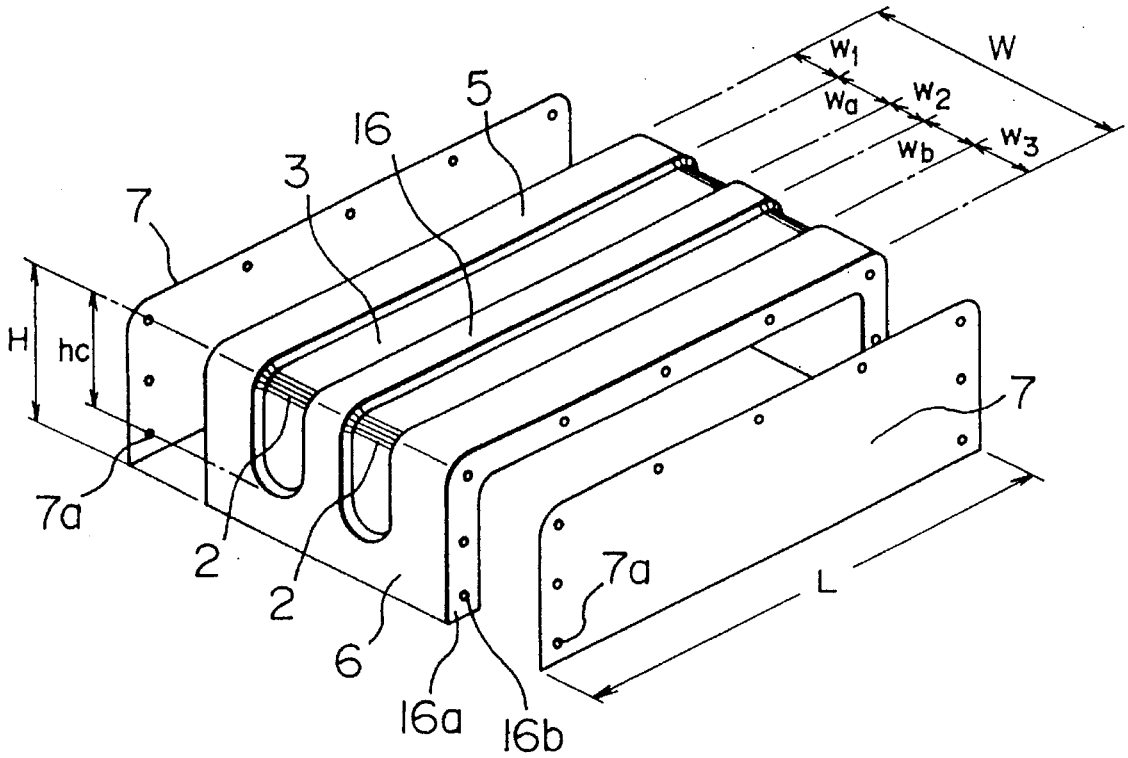
FIG. 10 is an explanatory perspective view showing a specific embodiment of the sheet-metal box structure according to the invention.

Next, a specific embodiment will be described with reference to FIG. 10. The sheet-metal box structure 1 shown in FIG. 1 is constituted of a U-shaped member 16 having a bottom portion 5 and side portions 6 with beads which are formed integrally, and two side portions 7 without beads. The U-shaped member 16 and the side portions 7 without beads are fastened on each other by screw-fasteners through screw-fastening holes 16*b* in screw-fastening bent portions 16*a* formed on the U-shaped member 16, and screw-fastening through holes 7*a* in the side portions 7 without beads. One example of dimensions of parts of the sheet-metal box structure 1 thus structured will be shown by use of reference characters in FIG. 10: L=800 mm, W=500 mm, wl=75 mm, $w_2$=150 mm, $w_3$=75 mm, wa=100 mm, wb=100 mm, H=300 mm, hc=250 mm, h=10 mm, and θ=45°. The sheet thickness t is 0.5 mm, and the material is cold-rolled steel sheets for deep drawing. In the U-shaped member 16, a plurality of V-shaped grooves are successively formed from the center of each bent portion toward opposite sides by means of several pieces of divided dies. Each V-shaped groove is formed by pressing an upper die between two crest portions of a lower die. The material is drawn from opposite sides so that a difference between inner and outer peripheral lengths generated in the bent portion is absorbed by the V-shaped grooves. This is one of the methods of forming the U-shaped member 16, and the U-shaped member 16 may be formed by other methods.

In the sheet-metal box structure 1 on which the ribs and the beads are formed according to the above-described embodiment, the rib height and the bead height are 20 times larger than the thickness t of sheet metal which constitutes the whole sheet-metal box structure 1. Therefore, its rigidity is high. As compared with a sheet-metal box structure reinforced by the conventional beads whose standard height is defined 3 to 5 times larger than the sheet thickness, and the ribs whose standard height is defined 2 times larger than the sheet thickness, the sheet thickness of the sheet-metal box structure 1 can be made smaller, thereby reducing the weight of the sheet-metal box structure 1.

Figure 9:
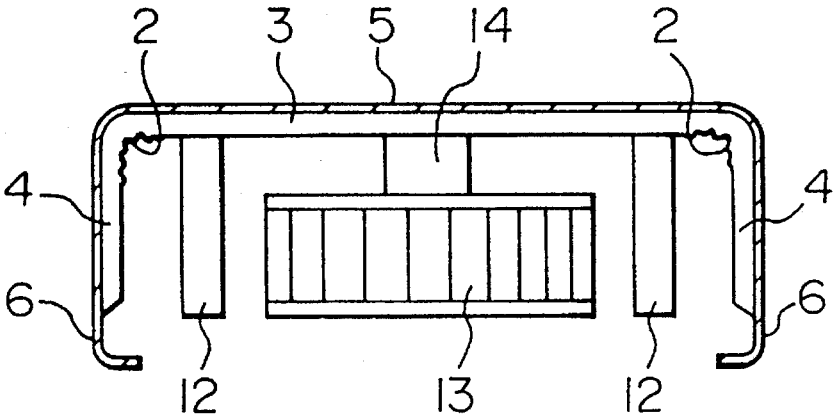
FIG. 9 is a schematic cross-sectional view showing the sheet-metal box structure according to the present invention when it is used for an indoor unit of an air conditioner.

FIG. 9 is a schematic cross-sectional view showing the sheet-metal box structure according to the present invention in the longitudinal direction of the ribs and beads when it is used for an indoor unit of an air conditioner. The ribs and beads are formed on the sheet-metal box structure 1 continuously from a side bead 4 formed on a side portion 6 with beads, to a corrugated rib 2, a bottom bead 3 formed on a bottom portion 5, and a side bead 4 on the opposite side. A fan 13 serving as air blowing and suction means, and a motor 14 for driving the fan 13 are provided on a bottom bead surface 3*a* of the sheet-metal box structure 1. A heat exchanger 12 surrounding the fan 13 is fixed on the bottom bead surface 3*a* and the bottom portion 5. When the sheet-metal box structure 1 is used for an indoor unit of an air conditioner, a heat insulating material is adhered to the sheet-metal box structure 1 except attachment portions of the above-mentioned component parts for the purpose of heat insulation and prevention of dew condensation. In FIG. 9, however, the illustration of the heat insulating material is omitted.

When the sheet-metal box structure 1 of the present invention is used for an indoor unit of an air conditioner as a shell on which heavy articles such as the fan 13 serving as air blowing and suction means, the driving motor 14, and the heat exchanger 12 are installed, as described above, the weight of the whole indoor unit can be reduced. Further, vibrations caused from the driving motor 14 are absorbed by the smaller-radius concave/convex sections 2*b* and 2*a* of the corrugated ribs 2 formed on the bent portions 9, so that noises of the indoor unit can be decreased. Therefore, the indoor unit of the air conditioner including the sheet-metal box structure 1 according to the invention has a light weight and causes less vibrations and low noises, thus increasing the value as a product.

In the illustrated embodiment, the smaller-radius concave/convex sections have a triangular cross-sectional configuration, and the number of convex sections 2*a* is six while the number of concave sections 2*b* is five. However, this invention is not limited to the triangular cross-sectional configuration and these numbers of sections in a strict sense. Concerning the taper concave/convex sections corresponding to the smaller-radius concave/convex sections as well, there may be employed other corresponding relationship between these two kinds of concave/convex sections and other shapes than those described above. Moreover, the cross-sectional configurations of the ribs and beads are not limited to a trapezoid nor a rectangle, and consequently, the taper angle in the case of trapezoidal cross-sectional configuration need not be 45°. Furthermore, the number of ribs and beads per box may be freely determined considering various factors such as rigidity, design and function.

The sheet-metal box structure according to the present invention has a high rigidity even if it is made of thin sheet metal. Therefore, shells, covers and so forth can be reduced in weight, i.e., devices including them can be reduced in weight. Further, even if heavy articles or vibration sources such as a motor are directly mounted on the sheet-metal box structure as a shell of an indoor unit of an air conditioner, vibrations are absorbed by the smaller-radius concave/convex sections 2*b* and 2*a* of the corrugated ribs 2 so that vibrations and noises can be decreased, thus enhancing the value as a product.

What is claimed is:

1. A high rigidity sheet-metal structure comprising:

sheet metal having bent portions;

ribs extending across the bent portions, the ribs extending in a bending direction of said bent portions and having a trapezoidal or rectangular cross-sectional configuration in a direction perpendicular to the bending direction, wherein a height of the ribs is 10 times or more larger than a thickness of the sheet metal;

a corrugated section formed on each rib at the bent portion thereof on a smaller radius side of the structure, the corrugated section having crest and valley portions extending in a direction perpendicular to the bending direction successively formed from a center line of each bent portion toward opposite sides thereof, wherein a continuous length of the bent portion in the bending direction on the smaller radius side is 1.0 to 1.4 times as large as a peripheral length of the bent portion in the bending direction on a larger radius side, and wherein a height of each rib in the bent portion from the larger radius side to a crest on the smaller radius side is larger than a height of the rib outside the bent portion.

2. A high-rigidity sheet metal structure according to claim 1,further comprising concave/convex sections corresponding to said crest and valley portions formed on side surfaces of the ribs which connect the larger-radius side and the smaller-radius side.

3. A high-rigidity sheet-metal structure according to claim 2, wherein beads having a cross-sectional configuration which is substantially the same as or similar to that of said ribs on the bent portions are formed on plane portions, continuously extending from said corrugated ribs on the bent portions.

4. A high-rigidity sheet-metal structure according to claim 1, wherein beads having a cross-sectional configuration which is substantially the same as or similar to that of said ribs on the bent portions are formed on plane portions, continuously extending from said corrugated ribs on the bent portions.

5. An indoor unit of an air conditioner including a high-rigidity sheet-metal structure which has bent portions formed with corrugated ribs according to claim 1.

6. A shell, a cover or the like including a high-rigidity sheet-metal structure according to claim 1 on which heavy articles or vibration sources such as a motor are directly mounted.

7. An apparatus or the like in which a sheet-metal structure according to claim 1 is used as a shell, a cover or the like on which heavy articles or vibration sources such as a motor are directly mounted.

8. An article receiving container including a sheet-metal structure which has bent portions formed with corrugated ribs according to claim 1.

* * * * *